US006546980B2

(12) United States Patent
Chen

(10) Patent No.: US 6,546,980 B2
(45) Date of Patent: Apr. 15, 2003

(54) METHOD OF FABRICATING BAMBOO SLATS FOR BAMBOO BLINDS

(76) Inventor: Feng-Yuan Chen, 3F, No. 28, Lane 29, Rose Rd., Hsin-Tien City, Taipei Hsien (TW)

( * ) Notice: Subject to any disclaimer, the term of this patent is extended or adjusted under 35 U.S.C. 154(b) by 0 days.

(21) Appl. No.: 09/888,404

(22) Filed: Jun. 26, 2001

(65) Prior Publication Data

US 2002/0195169 A1 Dec. 26, 2002

(51) Int. Cl.[7] ..... B27D 1/00

(52) U.S. Cl. ..... 144/350; 144/3.1; 144/347; 144/348; 144/351; 144/367; 144/369; 144/364; 144/380

(58) Field of Search ..... 144/3.1, 345, 346, 144/347, 350, 355, 367, 369, 364, 380, 348; 160/84.01, 168.1; 427/291; 428/105, 106, 378, 537.1

(56) References Cited

U.S. PATENT DOCUMENTS 4,128,119 A * 12/1978 Maier ..... 144/347
4,196,234 A * 4/1980 Fang et al. ..... 427/291
5,137,066 A * 8/1992 Dimter ..... 144/347
5,433,805 A * 7/1995 Schmidmeier ..... 156/256 X
5,505,238 A * 4/1996 Fujii et al. ..... 144/3.1 X
5,896,903 A * 4/1999 Chen et al. ..... 144/31 X
5,967,207 A * 10/1999 Chen ..... 144/380 X
5,972,467 A * 10/1999 Washo ..... 428/107
5,976,644 A * 11/1999 Sanaee et al. ..... 428/17
6,098,680 A * 8/2000 Nien ..... 144/380
6,192,949 B1 * 2/2001 Nien ..... 144/3.1 X
6,321,803 B1 * 11/2001 Nien ..... 144/380 X

* cited by examiner

*Primary Examiner*—W. Donald Bray
(74) *Attorney, Agent, or Firm*—Rosenberg, Klein & Lee

(57) ABSTRACT

A method for fabricating bamboo blind slats is disclosed. The steps include splitting a selected bamboo stem into several bamboo strips, removing the skins and joints from the bamboo strips before being disinfected and dried and then trimming them to fine bamboo strips. Further at least two bamboo strips are indented to joint with the corresponding ends, and then is trimmed to a fine jointed bamboo strip. A bamboo plate is obtained by joining fine jointed bamboo strips and/or the fine bamboo strips together in conjunction with a pneumatic press, and then is trimmed and polished. After slicing the bamboo plate into several bamboo slats, the bamboo slats need to be polished before covering a base coating, polished again before covering a face coating. Finally the bamboo slats are punched with two cord holes to be used for making a Venetian blind. The method increases the utilization of bamboo material by combining the processed divided bamboo strips to obtain more extensible, highly stable and anti-yielding bamboo slats.

13 Claims, 10 Drawing Sheets

METHOD OF FABRICATING BAMBOO SLATS FOR BAMBOO BLINDS

BACKGROUND OF THE INVENTION

1. Field of the Invention

The present invention relates to a method for fabricating bamboo blind slats, and more particularly, to the method capable of increasing the utilization of bamboo material by joining the processed divided bamboo strips to obtain more extensible, highly stable and anti-yielding bamboo slats for a Venetian blind.

2. Description of the Related Art

Conventionally, the slats for Venetian blinds are made from wooden material for the advantages of fine touch and good outer appearance. However, because it happened to excessively deforest all over the world in recent years, it is difficult to obtain sufficient supplies of wooden material. Additionally, there need ten years in average to grow trees so that the cost of wooden material has become much higher and higher. Furthermore, wooden blinds have short lifetime because the fiber structure of wooden slats cannot bear high pressing. One the other hand, polyvinyl chloride (PC) and aluminum are conventionally substitutions used for making slats for Venetian blinds. However, the fabrication of these kinds of slats will cause pollution. It is not good for the environment.

There are lots of U.S. Patents such as U.S. Pat. Nos. 5,896,903, 5,967,207 6,098,680 and 6,192,949 which disclose methods about manufacturing bamboo blind slats. However, the length of divided bamboo strips always limits the process to enhance the utilization of bamboo material. Thus, the improvement is existed.

SUMMARY OF THE INVENTION

It is therefore an objective of the present invention to provide a method for fabricating bamboo blind slats including: (i) selecting a preferable straight bamboo, cutting the selected bamboo stem in a predetermined length B, and splitting the bamboo into several strips with a width A; (ii) removing the skins and joints from two opposite longitudinal surfaces of the bamboo strips, disinfecting the dressed bamboo strips by boiling them in a diluted hydrogen peroxide solution or by a sulfur fume for 8 hours, drying the processed bamboo strips by baking at 50 to 60° C. for 48 hours, and then trimming around the bamboo strips into fine ones; (iii) indenting and coating an adhesive on one end or both ends of the bamboo strips to joint two indented bamboo strips by engaging the indented ends together, trimming the jointed bamboo strips and then covering an adhesive coating on two opposite transverse surfaces, stacking the trimmed bamboo strips one by one in a staggered arrangement (i.e. the joint surfaces of the bamboo strips therebetween will not align in the stacking direction), and adhering them together in conjunction with a pneumatic press to form a bamboo plate; (iv) trimming the bamboo plate on surfaces and then polishing by a polisher, slitting the polished bamboo plate into several bamboo blocks with a width C in transverse direction and then slicing the bamboo plate into several bamboo slats with a thickness E such as about 0.6 to 2.7 mm, and polishing the bamboo slat before being covered with a base coating obtained from a resin, surfacer and digestive fiber mixture and then polishing again before covering the base coated bamboo slats with a face coating obtained from a resin, surfacer, digestive fiber and organic solvent mixture such that the hardness of the finished bamboo slat is gained within 2H to 4H; and (v) punching the bamboo slat to provide two through holes with a distance F such as about 140 to 150 mm from the end edge and assembling a Venetian blind by accommodating the pull cords into the through holes.

This and other objectives of the present invention will no doubt become obvious to those of ordinary skill in the art after having read the following detailed description of the preferred embodiment which is illustrated in the various drawings and figures.

DETAILED DESCRIPTION OF THE PREFERRED EMBODIMENT

Figure 1:
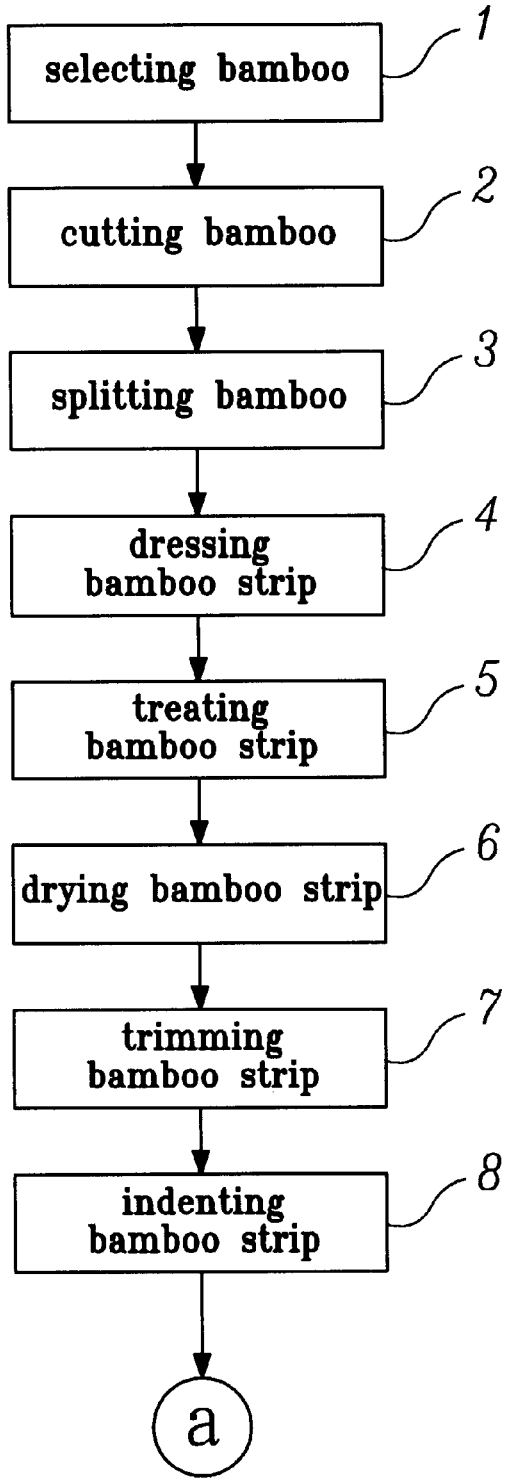
FIGS. 1 to 3 is a flow chart of the process for manufacturing bamboo blind slats according to the present invention.
Figure 2:
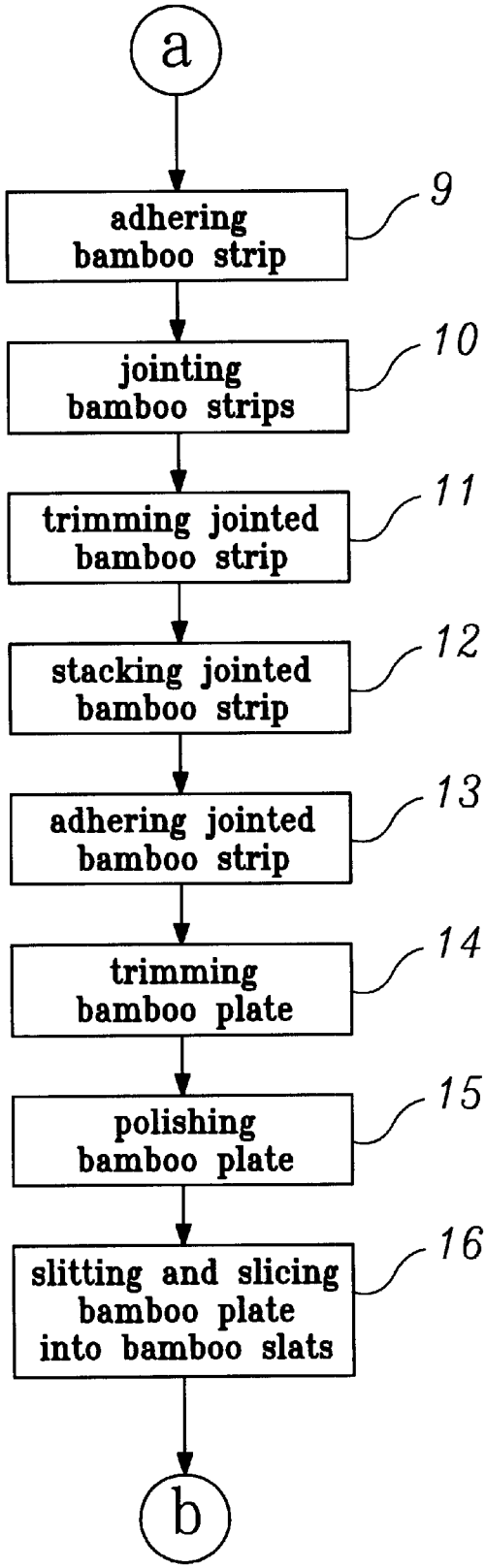
Figure 3:
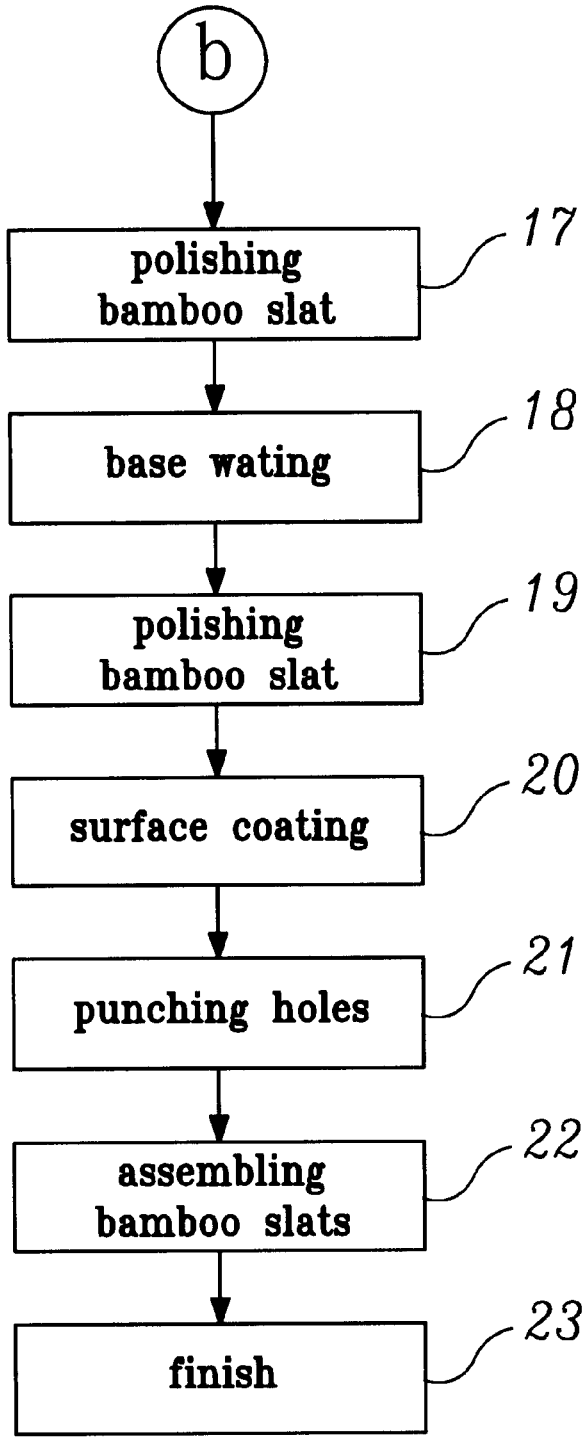

Please refer to FIGS. 1, 2 and 3, a bamboo blind of bamboo slats fabricating method according the present invention includes the steps as follows.

Figure 4:
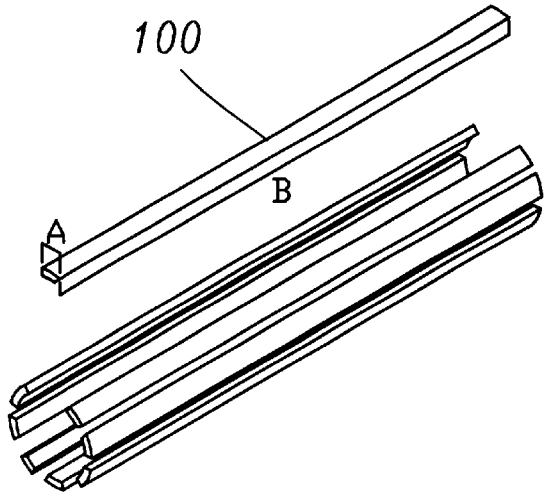
FIG. 4 shows a perspective view of a selected bamboo stem being split into several bamboo strips according to the method of the present invention.
Figure 5:
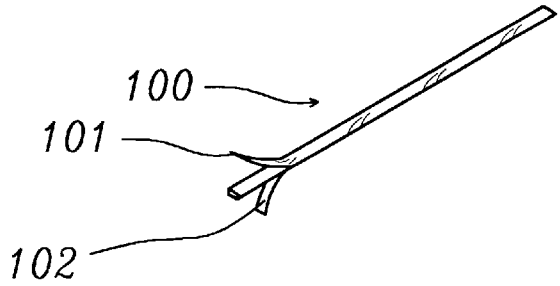
FIG. 5 shows a perspective view of dressing one of the bamboo strips of FIG. 4.

(i) In step 1, a preferable straight bamboo is selected, which preferably has a 4 to 5-year growth period, its stem is above 9 inches in diameter and about 10 to 26 mm in thickness, and its root is above 10 cm in length. In step 2, the selected bamboo is then cut in a predetermined length B (as shown in FIG. 4) which usually determines and limits the size in one direction while obtaining a bamboo plate to produce the bamboo slats in convention. However, in the present invention, the length in longitudinal direction of the bamboo plate according to following description can be extended and will not limited by this length B. In step 3, the cut bamboo is split into several bamboo strips 100 with a width A about 20 to 30 mm.

Figure 6:
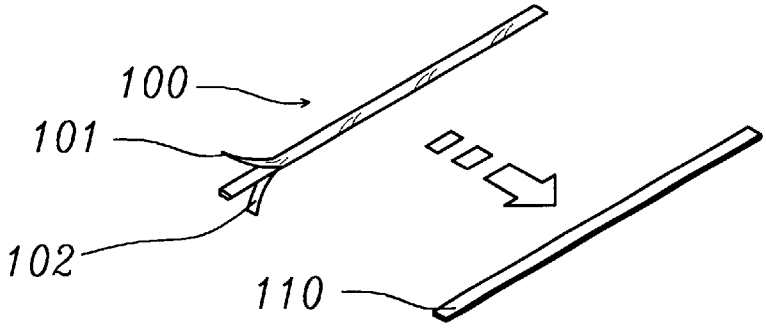
FIG. 6 shows a perspective view of further processing the dressed bamboo strip of FIG. 5.

(ii) In step 4, the bamboo strip 100 is dressed by removing the skins and joints from two opposite longitudinal surfaces 101 and 102 thereof. The dressed bamboo strip 110 (as shown in FIG. 6) is then disinfected by an antiseptic and anti-worm treatment in step 5 by boiling the bamboo strips 110 in a diluted hydrogen peroxide solution or processing in a sulfur fume for 8 hours. The processed bamboo strip 110 is further in step 6 dried by baking at 50 to 60° C. for 48 hours and then is trimmed around into a fine one.

Figure 7:
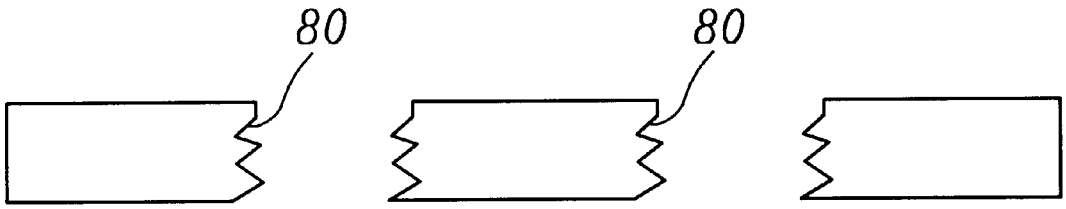
FIG. 7 shows a schematic diagram of aligning the processed bamboo strips of FIG. 6 by indenting one end or both ends thereof.
Figure 8:
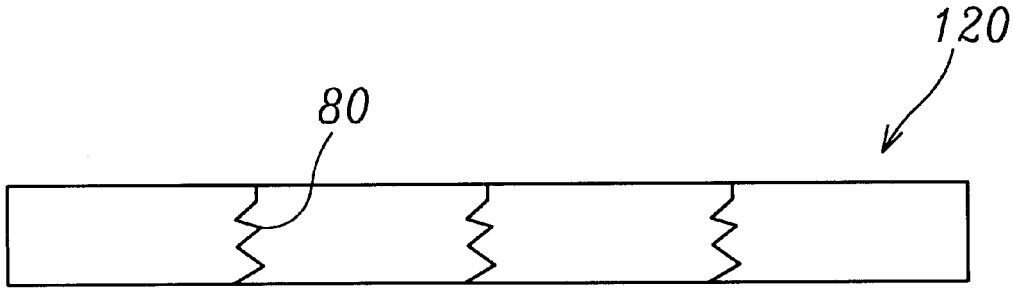
FIG. 8 shows a schematic diagram of jointing the indented bamboo strips of FIG. 7.
Figure 9:
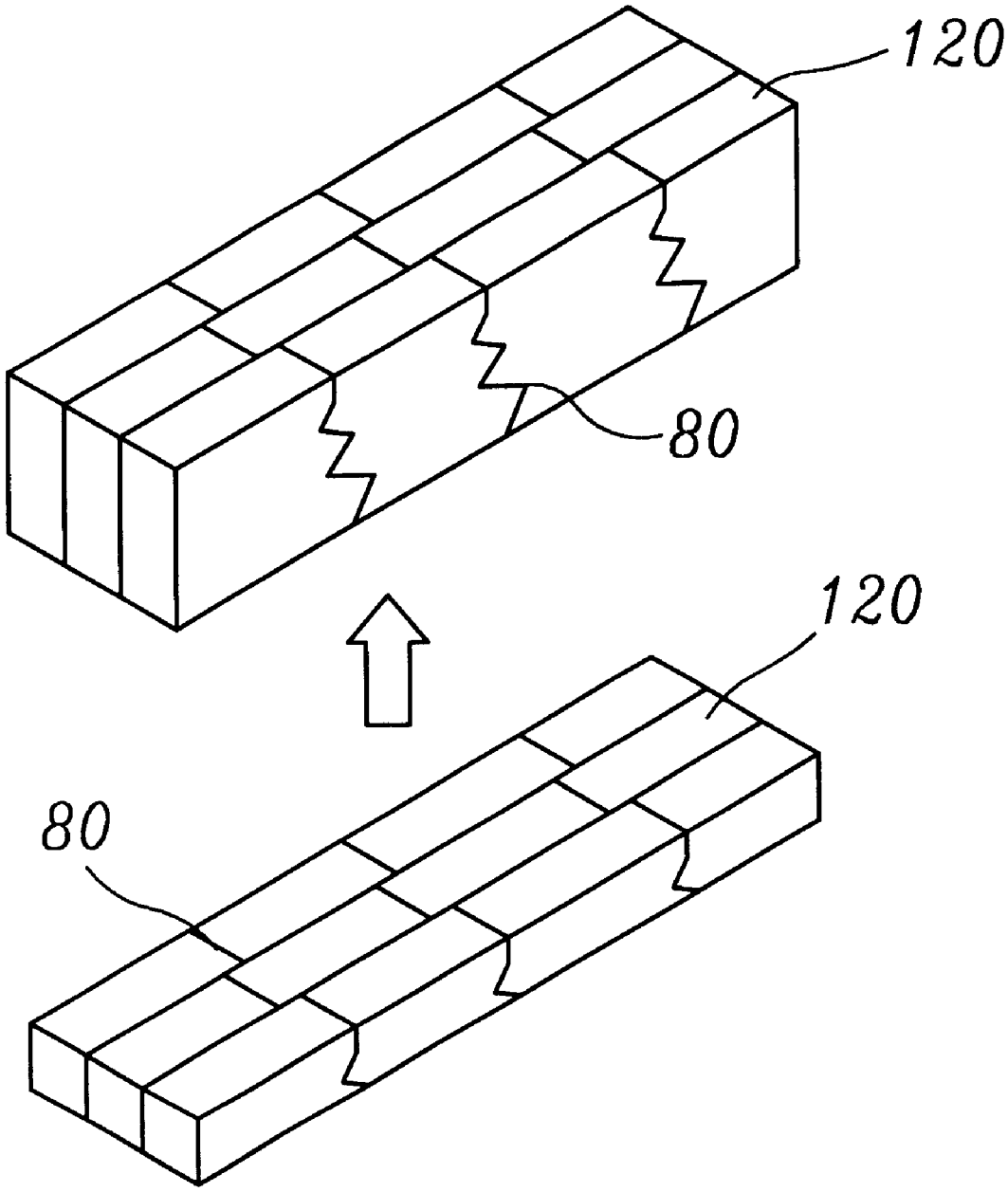
FIG. 9 shows a perspective view of stacking together the jointed bamboo strip of FIG. 8 in conjunction with a pneumatic press to form a bamboo plate.
Figure 10:
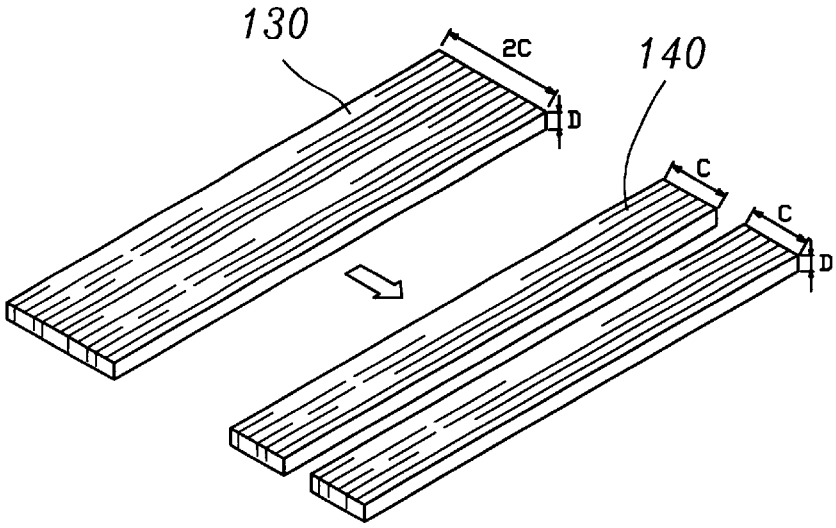
FIG. 10 shows a perspective view of cutting the bamboo plate into bamboo blocks according to the method of the present invention.

(iii) From steps 8 to 10, the fine bamboo strip 110 is indented n one end or both ends 80 shown in FIG. 7 and then are coated with an adhesive, such as mixing acrylic powder with resin, to have at least two bamboo strips being jointed together by indent joggling (as shown in FIG. 8). It is obvious to show that in one view of this procedure, one can joint several shorter bamboo strips (i.e. having shorter length than length B as shown in FIG. 4) to reach a predetermined length in longitudinal direction, thus more bamboo material can be selected to be used for fabrication so that increases the utilization of the bamboo material. On the other hand, if one uses traditional bamboo strips (i.e. having the same length B as shown in FIG. 4), it can obtain a much longer jointed bamboo strip to be extended in longitudinal direction. The jointed bamboo strip 120 is trimmed and then covered with an adhesive coating on two opposite transverse surfaces in step 11. Further, in step 12, at least three jointed bamboo strips are stacked one by one in a staggered arrangement (i.e. the indented joint surfaces of the bamboo strips therebetween will not align in the stacking direction) and adhered together in conjunction with a pneumatic press in step 13 to form a bamboo plate 130 having a transverse width equal to at least two times the width C of a slat (as shown in FIG. 9 and FIG. 10).

Figure 11:
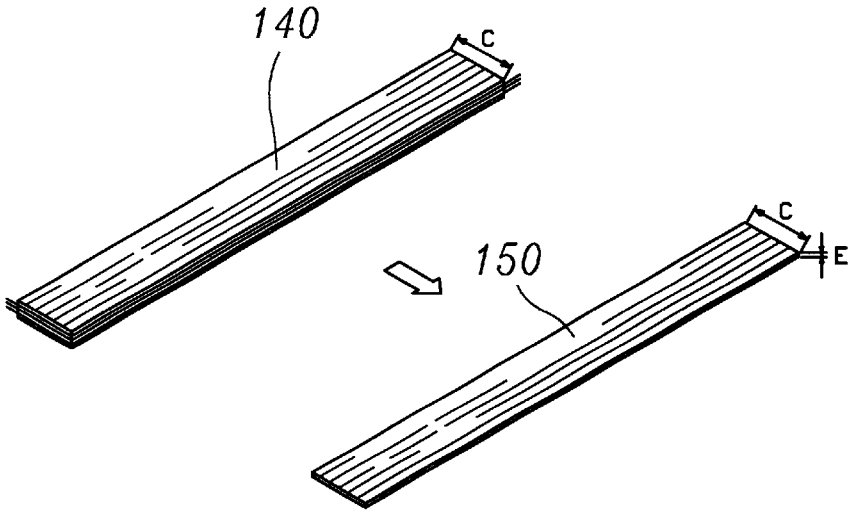
FIG. 11 shows a perspective view of slicing the bamboo block into bamboo slats according to the method of the present invention.
Figure 12:
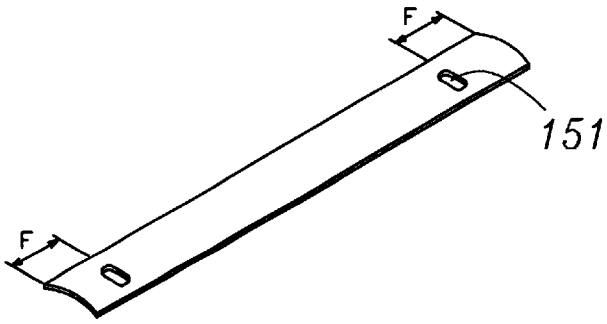
FIG. 12 shows a perspective view of punching the bamboo slats according to the method of the present invention.

(iv) In steps 14 and 15, the bamboo plate 130 is trimmed again on surfaces and then is polished by a polisher. Thereafter, the polished bamboo plate is slit into bamboo blocks 140 with a width C in transverse direction (as shown in FIG. 10), and then the bamboo plate 140 is sliced into bamboo slats 150 with a thickness E of 0.6 to 2.7 mm, as shown in FIG. 11 in step 16. The bamboo slat 150 is polished in step 17 before being covered with a base coating obtained from a resin, surfacer and digestive fiber mixture (step 18), and then is polished again (step 19) before covering the base coated bamboo slats with a face coating obtained from a resin, surfacer, digestive fiber and organic solvent mixture in step 20 such that the hardness of the finished bamboo slat is gained within 2H to 4H.

Figure 13:
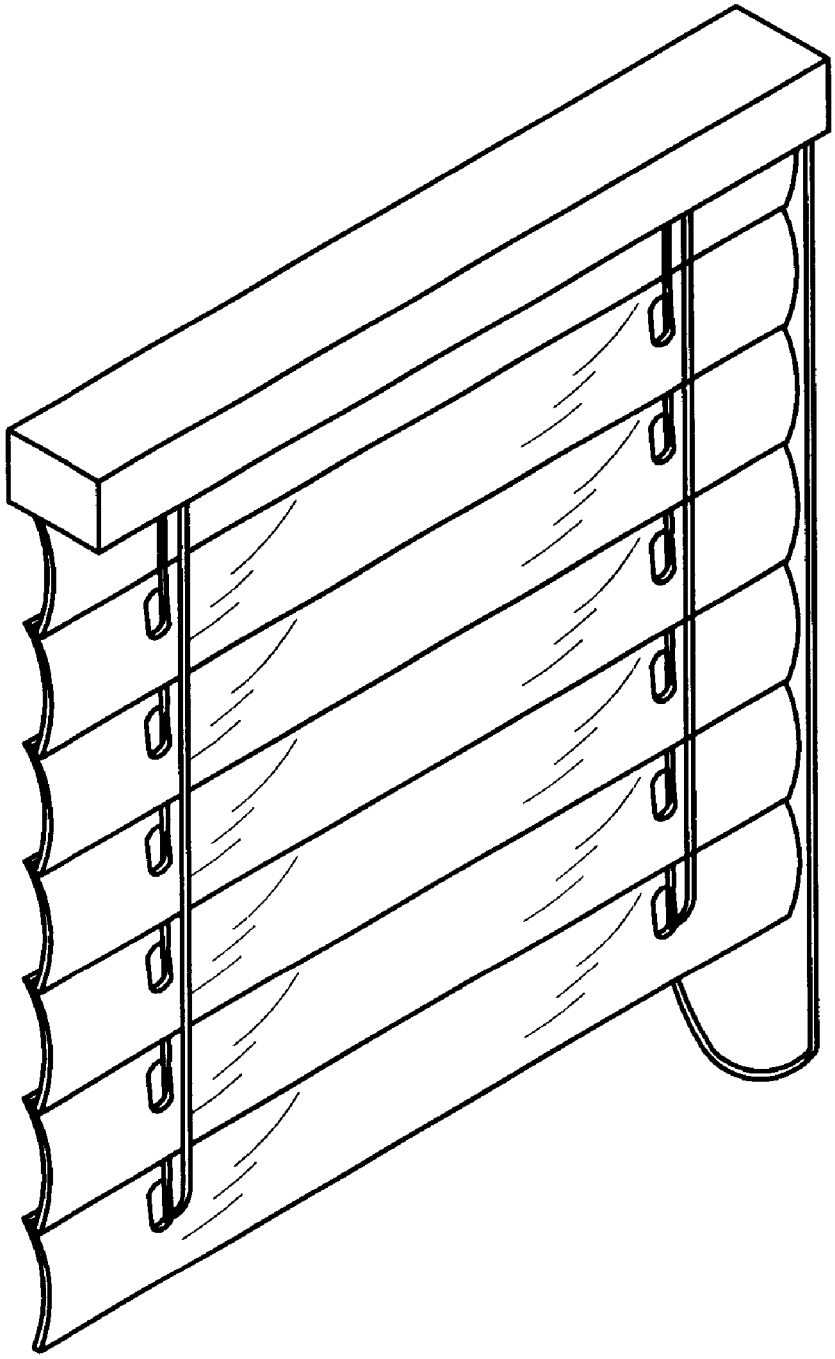
FIG. 13 shows a perspective view of a Venetian blind constructed with several bamboo slats made by the method of the present invention.
Figure 14:
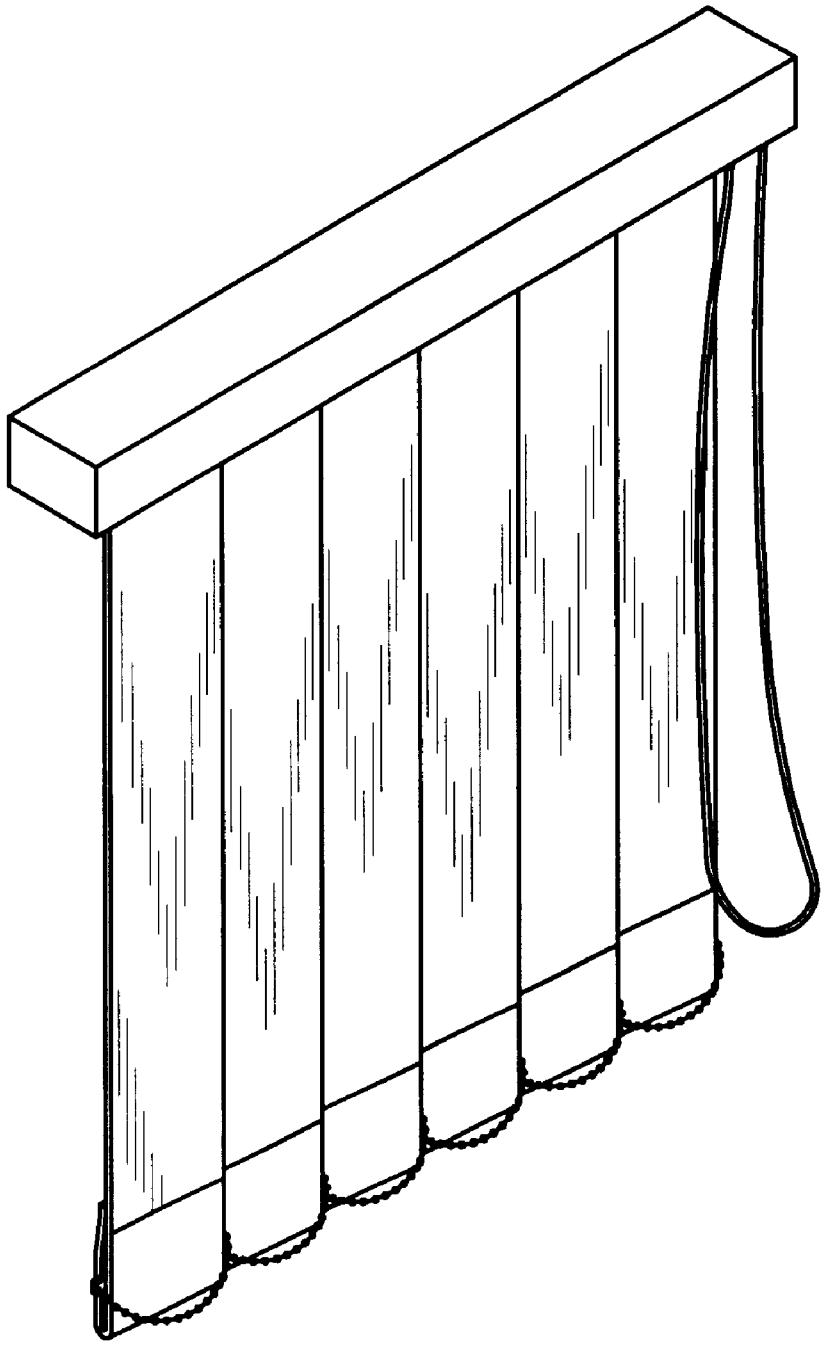
FIG. 14 shows a perspective view of another Venetian blind constructed with several bamboo slats made by the method of the present invention; and, FIGS. 15 to 17 show schematic diagrams of different engagements between two indented bamboo strips according to another preferred embodiment.

(v) In step 21, the bamboo slat 150 is punched to provide two through holes 151 with a distance F of 140 to 150 mm from the edge. Finally, in steps 22 and 23, the through holes 151 are intended to accommodate the pull cords to assemble a Venetian blind as shown in FIGS. 13 and 14.

Figure 15:
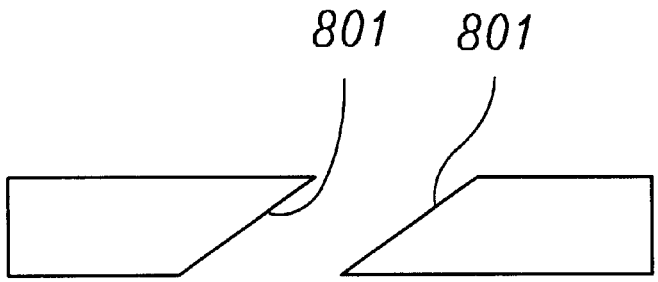
Figure 16:
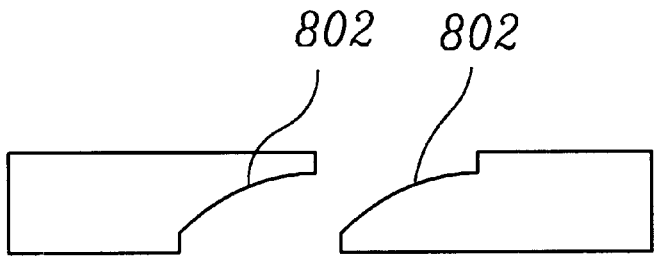
Figure 17:
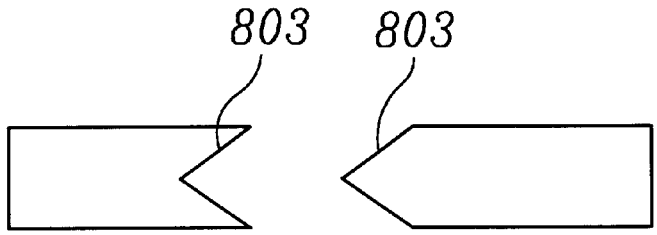

Referring to FIGS. 15 to 17, there are shown other embodiments of indented joggling for engaging two bamboo strips in above-mentioned step 8 of the present invention. The engagement can be as shown in these Figures with shapes like 801, 802 and 803, then two bamboo strips can be also jointed together.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A method for fabricating bamboo slats, comprising the steps of:

(1) splitting a selected bamboo stem into a plurality of bamboo strips, and successively removing skins and joints from both an outer surface and an inner surface thereof, disinfecting and drying said bamboo strips;

(2) jointing at least two bamboo strips with an indented engagement on each longitudinally corresponding end thereof to obtain a predetermined length of a jointed bamboo strip;

(3) adhering at least three jointed bamboo strips to obtain a bamboo plate; and (4) slicing said bamboo plate to obtain said bamboo slats.

2. The method of claim 1 wherein the disinfecting step includes the step of boiling said bamboo strips in a diluted hydrogen peroxide solution for 8 hours.

3. The method of claim 1 wherein the disinfecting step includes the step of exposing said bamboo strips to sulfur fumes.

4. The method of claim 1 wherein the adhering step (3) further comprises adhering said jointed bamboo strips together in a pneumatic press to obtain said bamboo plate having a transverse width equal to at least two times a width of said slat.

5. The method of claim 4 further comprising the steps of trimming and then polishing said bamboo plate before the slicing step (4).

6. The method of claim 1 further comprising the step of trimming said bamboo strips preceding the jointing step (2).

7. The method of claim 1 wherein the adhering step further includes the step of stacking said bamboo strips one by one in a staggered arrangement to obtain said bamboo plate.

8. The method of claim 7 wherein the stacking step includes the step of stacking a non-jointed bamboo strip to obtain said bamboo plate.

9. The method of claim 7 wherein the stacking step includes the step of transversely stacking said bamboo strips in a staggered arrangement to obtain said bamboo plate.

10. The method of claim 1 further comprising the step of polishing said jointed bamboo strips preceding the adhering step (3).

11. The method of claim 1 further comprising the steps of applying a base coating and then a surface coating on said bamboo slats after the slicing step (4).

12. The method of claim 11 further comprising the step of polishing said bamboo slats between the steps of applying the base coating and the surface coating.

13. The method of claim 11 further comprising the step of punching a cord hole after the coating steps.

* * * * *